United States Patent [19]

Zucker

[11] 4,205,541

[45] Jun. 3, 1980

[54] STOCK WASHER

[75] Inventor: Jerry Zucker, Lake Como, Fla.

[73] Assignee: Unice Machine Company, San Francisco, Calif.

[21] Appl. No.: 957,764

[22] Filed: Nov. 3, 1978

[51] Int. Cl.[2] ..... D06B 1/08; D06B 5/08; D21C 9/02

[52] U.S. Cl. ..... 68/200; 162/60

[58] Field of Search ..... 162/60, 242, 208, 214, 162/217, 317, 279; 210/216, 217; 68/200, 181 R; 8/156, 158; 15/302

[56] References Cited

U.S. PATENT DOCUMENTS

| | | | |
|---|---|---|---|
| 1,540,454 | 6/1925 | Ayers | 162/279 X |
| 3,419,466 | 12/1968 | Sepall | 162/208 X |
| 3,878,698 | 4/1975 | Eriksson et al. | 68/181 R X |
| 3,938,206 | 2/1976 | Stranger-Johannessen | 8/156 |

*Primary Examiner*—Richard V. Fisher
*Attorney, Agent, or Firm*—Townsend and Townsend

[57] ABSTRACT

An improved washer for removing impurities or other substances from a porous mat disposed over a vacuum head. As disclosed, in connection with an industrial paper making process, the porous mat is paper pulp and an elongate chamber, disposed axially above the drum, has a slot along its bottom with resilient downwardly extending skirts disposed around the edges of the slot. Water under pressure in the chamber is directed downward, and into the pulp mat. The resilient skirts prevent the wash water from flowing tangentially with respect to the mat so that the flow of water into the mat is essentially perpendicular to the mat. The chemicals within the mat are positively displaced by relatively clean wash water.

5 Claims, 4 Drawing Figures

STOCK WASHER

BACKGROUND OF THE INVENTION

Various industrial processes often require that a mass of porous material to washed in order to remove chemicals or other impurities. For example, this need appears in the sugar industry, where sugar is washed from bagasse; in the textile industry, where excess dyes are washed from the fabric; in mining, where impurities are washed from ore; and in the paper industry, as follows.

In a standard paper production line, wood chips are cooked with chemicals in aqueous solution, the precise composition of the cooking chemicals depending on the particular process. This step, normally carried out in a digester under heat and pressure, breaks down the wood by dissolving the organic compounds that hold the cellulose fibers together.

The mixture of pulp, spent cooking chemicals, and organic materials, collectively known as stock, is then fed to a series of washers. The most common type of washer system includes a rotary vacuum drum onto which the stock is spread. The drum is perforated, and a vacuum maintained inside causes the separation of liquid from the pulp. The mixture assumes the form of a pulp mat which is still impregnated with chemicals and organics. A washer usually disposed above, and extending axially along the drum directs water at and through the pulp mat to remove these substances. A typical installation would use three washer drums in sequence, with wash water being flowed counter-current to the direction of the pulp movement so that the final washing stage uses clean water. An additional washing stage to remove bleaching chemicals is required if the washed pulp is subsequently bleached.

The effluent from the washers, comprising water, spent cooking chemicals, and organic materials is referred to as liquor. In a kraft (or sulfate) process, it is called black liquor; in a sulfite process, red liquor. Typical liquor contains approximately 15% solid material. It is desirable to separate this solid material from the water to allow reuse of the inorganic pulping chemicals, and to eliminate the environmental problem of disposing of the liquor.

Evaporation is the standard separation method, with the liquor being passed through a series of evaporators, in which steam is passed countercurrent to the liquor flow. In this way, the liquor is concentrated until it contains approximately 60% solids, at which point it is burnt in a boiler. The organic materials provide the fuel value to generate the steam, and the inorganic chemicals smelt out the bottom of the boiler. In atypical paper mill, the steam from the liquor recovery part of the cycle supplies most of the mill's steam needs.

It is apparent that the more dilute the liquor, the more energy must be expended in evaporating the water in order to recover the solids. This is energy that is therefore unavailable for other energy needs of the paper mill. At the same time, it is necessary to efficiently remove the chemicals from the pulp to provide a satisfactorily clean pulp. A thorough washing militates toward the formation of dilute liquors.

Two standard types of paper pulp mat washers are the weir and the whistle shower. In the former, the water stored in a reservoir above the rotary vacuum drum on which the pulp mat is disposed is allowed to overflow a weir that extends axially along the entire length of the drum. Thus, in principle, a sheet of water falls along the entire width of the pulp mat. A difficulty with this type of a shower, is that the weir shower, a relatively long piece of equipment supported at its ends, has a tendency to sag, and is further prone to misalignment. In such cases, more water overflows the weir at its lowest portions than elsewhere, thereby washing some portions of the pulp mat less effectively than others. In a whistle shower, nozzles disposed above and axially along the pulp mat direct water at the mat. A difficulty with this type of washer is that the nozzles can easily become plugged, resulting in incomplete washing of the pulp mat. Satisfactory washing with weir or whistle showers typically requires three showers arranged in a parallel configuration above the drum.

Thus, there is a need for a washer having a high efficiency and not subject to problems that result in only a portion of the pulp mat's being washed.

SUMMARY OF THE INVENTION

The present invention is an improved washer for removing chemicals from a porous mat disposed over a vacuum rotary drum. The improved washer reliably washes substantially the entire width of the mat, and is able to accomplish washing equivalent to prior art washers with a smaller amount of water, and often with a smaller number of showers.

Broadly, the invention comprises an elongate chamber disposed axially above the drum. The chamber has a slot along its bottom with resilient downwardly extending skirts disposed around the edges of the slot. The water between the skirts and adjacent the mat is at an elevated pressure due at least in part to the static head of the water in the chamber. This pressure, in combination with the vacuum within the drum causes the water to flow into and through the pulp mat. The resilient skirts prevent the wash water from flowing outwardly (i.e., tangentially with respect to the mat) so that the flow of water into the mat is essentially perpendicular to the mat. In this fashion, the chemicals within the mat are positively displaced by the relatively clean wash water, resulting in improved efficiency.

According to one aspect of the invention, horizontal and vertical dispersion plates within the chamber provide an even flow of water under pressure so that the entire mat is washed with the same efficiency.

Adjustable jacks at both ends of the washer allow the height of the washer above the drum to be varied in order to accommodate pulp mats of different thicknesses. The washer height is set such that the flexible skirts graze the surface of the mat, thereby sealing the water to the rotating mat while allowing for variations in mat thickness.

The height of the water in the chamber above the drum represents potential energy for directing water through the mat. While conventional showers dissipate part of this energy by splashing the water against the mat, the present confines the water adjacent the mat so that the static pressure head is effectively used.

The improved penetration of the water into and through the mat, with a resultant positive displacement of the chemicals or other materials to be removed, results in a more effective washing for a given amount of water, or equivalently, a smaller water requirement for a given wash effectiveness. The water saving translates into an energy saving at the liquor recovery step.

The internal dispersion plates provide a generally uniform water pressure along a line transverse to the movement of the mat, and the resilient skirts seal the pressurized water to the mat in spite of variations in the mat thickness.

This manner of deploying the wash water ensures that the entire lateral dimension of the mat is washed. This often makes it possible to get reliable washing with fewer washers.

DESCRIPTION OF THE PREFERRED EMBODIMENT

Broadly, the present invention washes chemicals or other substances out of a porous mat by directing a pressurized column of water perpendicularly through the mat. The mat is typically disposed on a vacuum head, such as a rotary vacuum drum.

Figure 1:
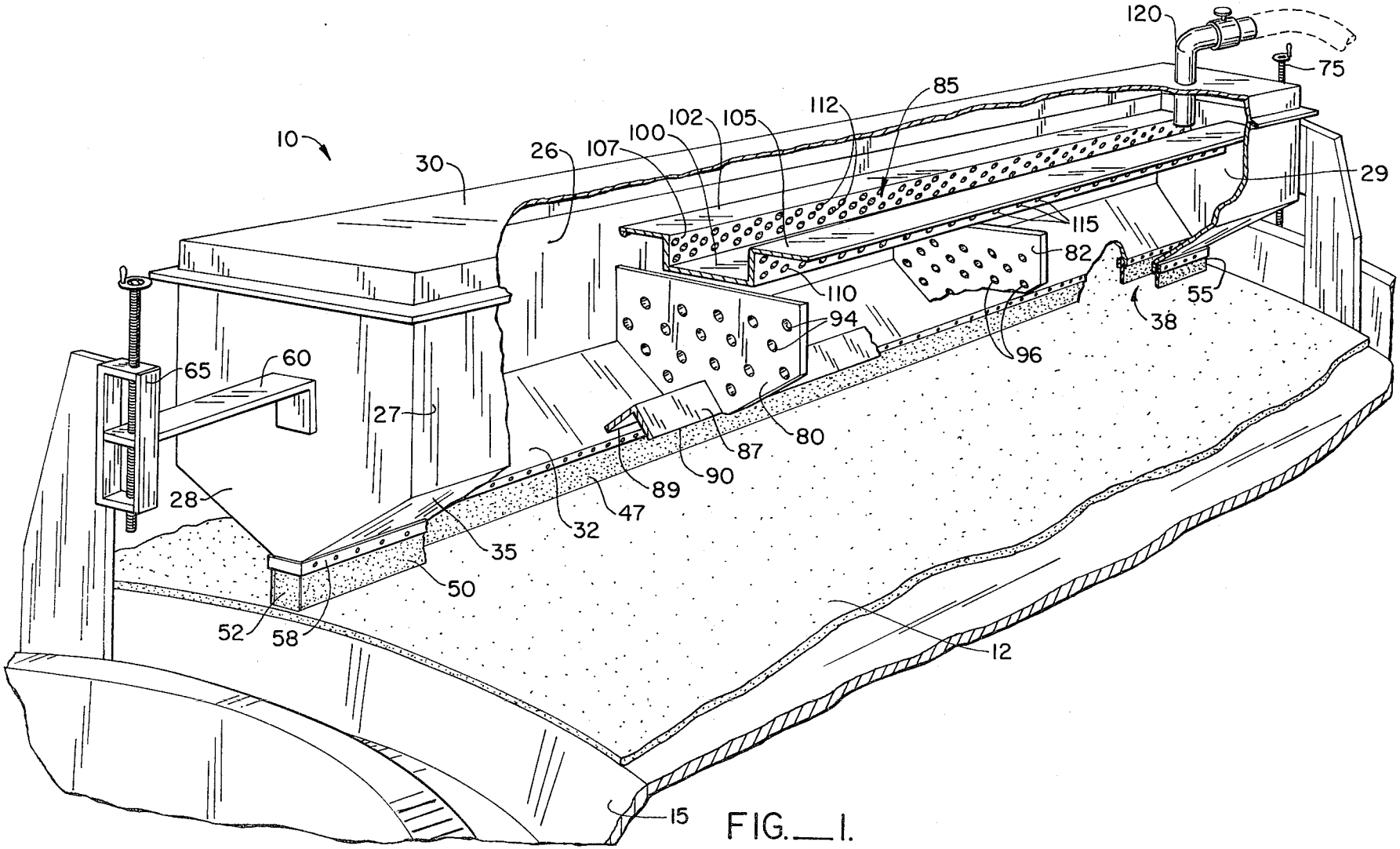
FIG. 1 is an overall perspective view of a washer disposed above a paper pulp mat on a vacuum drum, partially cut away to show the internal components.
Figure 2:
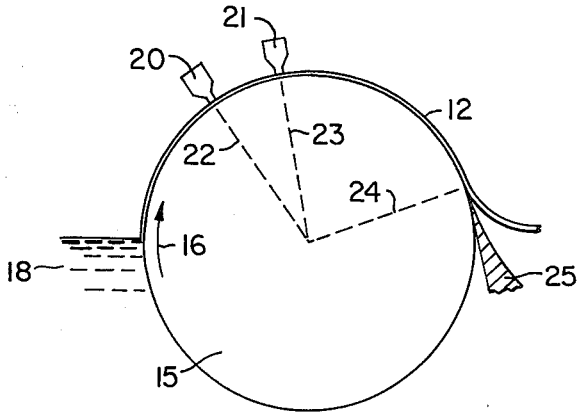
FIG. 2 is a schematic view showing a typical disposition of two washers on a drum.

FIG. 1 shows a single axially extending washer 10 positioned above a paper pulp mat 12 which is formed on rotary vacuum drum 15. It should be understood that the washer need not be vertical, but may be tilted (see for example FIG. 2 which shows a typical disposition of washers with respect to the rotary vacuum drum.) For convenience, however, the components will be referred to as if the washer is vertically oriented as shown in FIG. 1.

In order to clearly set forth the features and operation of the present invention, a brief summary of the operation of rotary vacuum drum 15 is useful. This is best done with reference to FIG. 2. Rotary drum 15 is mounted for rotation about a horizontal axis in the direction of arrow 16. Stock comprising pulp, spent cooking chemicals and water is continuously fed from a digestor into a vat where it forms a pool 18 in which drum 15 is partially submersed. Drum 15 has a perforated outer shell and a source of vacuum inside that is communicated to the outside through the perforations. Therefore, as drum 15 rotates, pulp mat 12 forms on the outside of the drum and liquid is withdrawn by the vacuum.

At a position generally near the top of the drum, the mat passes under one or more washers whose purpose is to remove chemical impurities. If weir or whistle showers were used, three would be required, but with the present invention, proper washing can often be achieved with two washers per rotary vacuum drum. A typical alignment would have washers 20 and 21 situated above drum 15 at approximately 35° and 10° before top dead center, indicated by dashed lines 22 and 23 respectively.At a point approximately 70° beyond top dead center, indicated by dashed line 24, the vacuum is released and the pulp mat separated from the rotating drum. The separation is effected by a doctor blade 25 or the like, which may be a mechanical device or may comprises a linear array of nozzles for directing pressurized air or steam upwardly underneath the mat. The washed mat is then sent to subsequent washing stages with similar vacuum drum/washer configurations.

Figure 3:
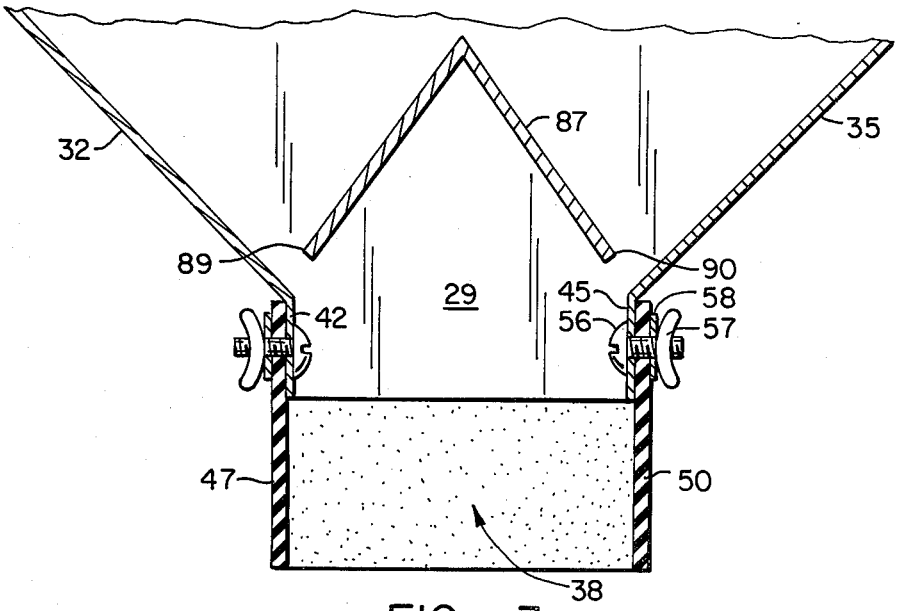
FIG. 3 is a sectional view showing the skirt attachment to the washer.

Having thus set forth the relation between the individual washers and the rotary vacuum drum, the particular configuration of a washer can be discussed. Referring to FIGS. 1 and 3, washer 10 comprises an elongate chamber defined by axially extending side walls 26 and 27, end walls 28 and 29, top 30, and sloping bottom panels 32 and 35. Downwardly sloping panels 32 and 35 are angled toward one another, but terminate before they meet, thereby defining an elongate slot 38 extending axially along the bottom of the chamber. Sloping panels 32 and 35 are provided with respective downwardly extending flanges 42 and 45 along their lengths. Resilient skirts 47 and 50 are affixed to flanges 42 and 45 along their respective lengths, and extend downwardly to contact the pulp mat along its axial dimension. Resilient end flaps 52 and 55 extend the width of slot 38, and together with skirts 47 and 50, provide a continuous sealing structure about the entire perimeter of slot 38. Skirts 47 and 50 may be attached to their respective flanges in any convenient manner. FIGS. 1 and 3 show a mounting using bolts. Thus, skirt 50 is attached to flange 45 by a plurality of bolts 56 and wingnuts 57. Perforated rigid strip 58 between wingnuts 57 and skirt 50 provides a relatively uniform fastening.

End wall 28 is fitted with mounting bracket 60 which engages screw jack 65. Jack 65 is affixed to support bracket 70 mounted to the fixed structure supporting rotary vacuum drum 15. A similar arrangement including jack 75 at the other end allows the height of washer 10 above pulp mat 12 to be adjusted so that resilient skirts 47 and 50 just touch pulp mat 12 along its entire axial dimension.

Disposed within the chamber of washer 10 are vertical dispersion plates 80 and 82, and horizontal dispersion plate 85. Vertical plates 80 and 82 are perpendicular to the axial dimension of the washer, and each extends horizoontally from side wall 26 to side wall 27. Plates 80 and 82 each extends vertically from sloping bottom portions 32 and 35 to a height part way up side walls 26 and 27. Each of plates 80 and 82 has a downwardly opening V-shaped notch into which is seated a downwardly facing V-shaped channel member 87. The V-shaped notches and V-shaped channel are sized so that the axially extending edges 89 and 90 of V-shaped channel 87 do not touch either sloping bottom portions 32 and 35 or flanges 42 and 45, but rather leave a small clearance, typically ¼", for water flow as will be described below. Each of plates 80 and 82 is provided with a plurality of apertures, plate 80 having apertures 94 and plate 82 having apertures 96. These apertures are sufficiently large that they do not become plugged by fibers entrained in the wash water.

Horizontal dispersion plate 85 extends from side wall 26 to side wall 27, and from end wall 28 to end wall 29. Plate 85 has an axially extending central depression, thereby defining lower horizontal portion 100, paired upper horizontal portions 102 and 105, and vertical portions 107 and 110. Upper horizontal portions 102 and 105 are spaced horizontally by lower horizontal portion 100, and are spaced from lower portion 100 by vertical portions 107 and 110. The location of plate 85 and the depth of its central depression is such that horizontal lower portion 100 is slightly above the top edge of vertical dispersion plates 80 and 82. Each of vertical portions 107 and 110 is provided with a plurality of apertures, portion 107 having apertures 112, and portion 110 having apertures 115. Conduit 120 pierces cover 30, typically near one end thereof to provide fluid communication with the interior the chamber of washer 10.

Figure 4:
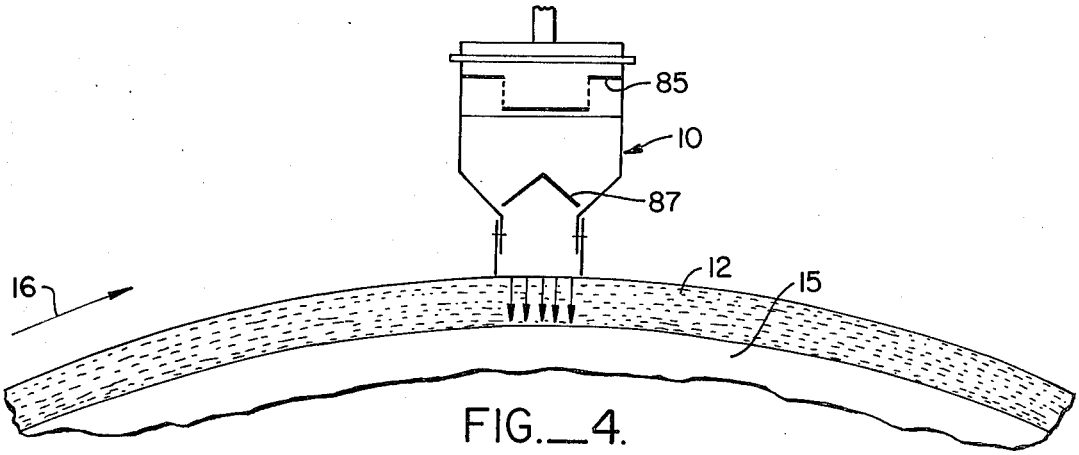
FIG. 4 is a schematic section showing the operation of the washer.

FIG. 4 is a schematic showing the operation of the washer. Washer 10 is disposed above pulp mat 12 on rotary vacuum drum 15. Water entering the internal chamber of washer 10 through conduit 120 flows into the depression of horizontal dispersion plate 85, flows through apertures 112 and 115, past V-shaped channel 87, and into the region between skirts 47 and 50, thus contacting the outer surface of pulp mat 12. The water in contact with the mat is at a pressure above atmospheric due to the static pressure head resulting from the height of washer 10 above mat 12. Additional pressure may be achieved by ensuring that cover 30 is sealed to the walls, and introducing the water into the chamber under pressure. This is not typically done, so that the water pressure adjacent the mat normally arises from the static head alone. In such cases, water is generally maintained in washer 10 at a level somewhere around that of plate 85.

The water in contact with the pulp mat is at a higher pressure than the pressure on the inside of the rotary vacuum drum. This is partially due to the vacuum maintained within the drum, and partly due to the elevated pressure of the water between the skirts. The skirts 47 and 50 prevent movement of this water tangentially with respect to the mat. Since the mat is porous, the pressure differential causes the water to flow perpendicularly through the mat to the interior of the drum. As the water between the skirts flows through the mat, water above it in the chamber replaces it. The flow of water into the mat positively displaces water and chemicals within the mat, thereby effecting a cleaning.

The location of the washers (e.g. 35° and 10° before top dead center as described above) is chosen to allow most of the liquid in the mat to be withdrawn by the vacuum before the mat passes under the washers. That is, the mat approaches the first washer in a relatively dry state. The relative location of the washers is also chosen to allow withdrawal of most of the liquid injected by one washer before injection of liquid by a subsequent washer. In this way, the wash water is used most effectively.

The washer components with the exception of the skirts and end flaps are preferably made of stainless steel to resist the effect of the chemicals. This is usually important, since a typical installation uses wash water several times before it is sent to the liquor recovery step. Thus, only the last washer in the sequence would be using clean water, the earlier washers using water that has a considerable amount of chemicals in it. The skirts are preferably made of a resilient material to accommodate irregularities in the mat. At the same time, they must be rigid enough to prevent tangential flow of the water between the skirts which is at an elevated pressure. The material must also be resistant to chemical attack. Neoprene rubber is preferred.

I claim:

1. A washer for removing chemicals from a mat of porous material impregnated by the chemicals, the mat being disposed over a portion of a rotary vacuum drum, comprising:

an elongate chamber outside the drum and disposed parallel to the axis of the drum, the chamber having means defining a longitudinal slot proximate the drum;

paired resilient skirts disposed along the chamber adjacent the edges of the slot, the skirts extending from the slot toward the drum a distance sufficient to maintain them in close proximity with the mat;

inlet means for introducing a volume of water into the chamber;

dispersion means within the chamber and disposed between the inlet means and the region between the skirts, such that water passing from the chamber into the region between the skirts is maintained at generally uniform pressure regardless of pressure variation within the water between the inlet means and the dispersion means; and means for causing the water between the skirts to be at a pressure in excess of the pressure inside the drum and thus directing the water through the mat, the skirts preventing motion of the water parallel to the mat so that the volume of water between the skirts is directed substantially perpendicularly through the mat, displacing a portion of the chemicals therein.

2. The invention of claim 1, also comprising first and second adjustment means at the ends of the chamber for varying the distance of the chamber from the surface of the mat to accommodate mats of different thickness.

3. The invention of claim 1 wherein the dispersion means comprises an apertured plate defining first and second regions within the chamber such that water entering the chamber through the inlet means passes from the first region to the second region through the apertured plate prior to flowing between the skirts.

4. A washer for removing chemicals from a mat of porous material impregnated by the chemicals, the mat being disposed over a portion of a rotary vacuum drum, the drum being rotatably mounted to a fixed structure, comprising:

an elongate chamber outside the drum and disposed parallel to the axis of the drum, the chamber including first and second spaced parallel walls extending axially, each wall having a first edge remote from the drum and a second edge between the first edge and the drum, a cover extending axially the length of the walls and spanning the distance between them along their respective first edges, first and second axially disposed sloping panels extending toward one another and toward the drum from the respective second edges of the first and second walls, the first and second sloping panels extending inwardly and terminating at a separation less than the spacing between the side walls, first and second parallel flanges along the respective edges of the first and second sloping bottom panels nearest the drum, the flanges extending from the bottom panels toward the drum, and first and second ends, wherein the walls, the cover, the sloping panels, and the ends define a closed chamber having an elongate slot proximate the drum;

first and second resilient skirts extending along the axis of the drum, the first and second skirts being fastened to the first and second flanges, respectively, and extending therefrom toward the drum;

first and second end flaps extending between the resilient skirts, and mounted on the first and second ends respectively, wherein the end flaps and the skirts surround the elongate slot;

adjustment means coupling the chamber to the fixed structure, the adjustment of means being adapted to vary the distance of the first and second ends from the central axis of the drum, such that the skirts may be brought into close proximity with the mat;

conduit means for introducing a volume of water into the chamber;

a plate within the chamber, the plate defining a first region bounded by the plate, the walls and the cover, and a second region bounded by the plate, the sloping panels, and the skirts, extending between the first and second walls generally parallel to the cover, the plate defining a plurality of apertures passing therethrough, such that water passing through the apertures from the first region into the second region is maintained at a generally uniform pressure regardless of pressure variation within the water in the first region of the chamber; and means for causing the water in the second region to be at a pressure in excess of the pressure within the drum;

whereby the water between the skirts is directed substantially perpendicularly through the mat, displacing a portion of the chemicals therein.

5. The invention of claim 4 wherein the adjustment means comprises first and second screw jacks coupling the first and second ends respectively to the fixed structure.

* * * * *